US006202835B1

(12) United States Patent
Morse

(10) Patent No.: US 6,202,835 B1
(45) **Date of Patent: *Mar. 20, 2001**

(54) METHODS AND DEVICES FOR RETAINING AND DISTRIBUTING COINS

(76) Inventor: Owen Webber Morse, 2112 Burnt Mill Rd., Tustin, CA (US) 92782

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/089,303

(22) Filed: Jun. 2, 1998

(51) Int. Cl.[7] ..... A45C 1/00
(52) U.S. Cl. ..... 206/0.84; 206/564
(58) Field of Search ..... 206/0.8, 0.81, 206/0.84, 38, 37, 486, 487, 559, 564, 445; 150/150; 53/473, 475

(56) References Cited

U.S. PATENT DOCUMENTS

| | | | | |
|---|---|---|---|---|
| 421,984 | * | 2/1890 | Staats | 206/0.84 |
| 2,344,310 | * | 3/1944 | Kominik | 206/0.84 |
| 3,047,144 | * | 7/1962 | Wissel | 206/445 |
| 3,075,638 | * | 1/1963 | Blendinger | 206/0.84 |
| 3,638,849 | * | 2/1972 | Goings | 206/564 |
| 3,913,732 | * | 10/1975 | Peterson | 206/0.84 |
| 4,063,639 | * | 12/1977 | Grant | 206/0.84 |
| 4,402,399 | * | 9/1983 | Friess | 206/0.84 |
| 4,836,365 | | 6/1989 | Hall . | |
| 4,878,579 | * | 11/1989 | Hager | 206/0.84 |
| 5,191,972 | * | 3/1993 | Helzer et al. | 206/0.8 |
| 5,492,504 | * | 2/1996 | Wolters | 206/0.84 |
| 5,499,710 | | 3/1996 | Hoffman . | |

* cited by examiner

*Primary Examiner*—Luan K. Bui
(74) *Attorney, Agent, or Firm*—Oppenheimer Wolff & Donnelly, LLP

(57) ABSTRACT

A change card includes a plurality of bays which is configured to hold a combination of coins that allows a user to make exact change for any purchase and/or to receive all of the change resulting from a purchase. The change card includes a body on which the plurality of bays is disposed. Each of the bays is adapted to releasably receive a coin. The change card may be configured to be about the same size as a credit card. A change card configured for use in the United States may include a predetermined number of bays consisting of four bays for receiving pennies, one bay for receiving a nickel, two bays for receiving dimes, and three bays for receiving quarters, which totals 10 coins. Accordingly, exact change may be made for a purchase of given dollar amount and any fractional amount in cents, ranging from 1¢ to 99¢ with only these 10 coins.

10 Claims, 5 Drawing Sheets

METHODS AND DEVICES FOR RETAINING AND DISTRIBUTING COINS

BACKGROUND OF THE INVENTION

1. Field of the Invention

The present invention relates to devices which retain coins. More particularly, the present invention relates to a change card, as well as methods for using the change card, which retains a specific combination of coins with which exact change for any purchase may be made. The methods for using the change cards of the present invention allows all of the change resulting from a purchase to be received by the change card. The methods and devices of the present invention, by maintaining and controlling an exact predetermined combination coins with which a person may make any purchase, eliminate the burden of loose change.

2. Description of the Related Art

Throughout the course of a day of making purchases, a person accumulates loose change. This gradual accumulation results a pocket or a purse filled with coins at the end of the day. Although it may be carried with a person day after day, a coin purse eventually becomes too full and needs to be emptied. In contrast, a pocket filled with coins is typically dumped on top of a dresser or into a tray upon returning home at the end of the day. Eventually, a person ends up with a substantial supply of coins. On a national scale, the collective supplies of loose change represents a massive amount of coins removed from circulation.

To return their supply of coins back into circulation, individuals need to roll the coins into paper wrappers, which is time consuming and a nuisance, or to take the coins to a bank for this purpose. However, many banks no longer provide this service. To fill this void, companies have developed machines which are often placed in supermarkets which, in return for coins, provide cash, albeit for a not insubstantial commission.

To cope with the accumulation of loose change, a person may use a coin purse which is typically kept in a pocket or a larger purse. Other devices have been developed to retain coins. For example, a portable coin holder and dispenser disclosed in U.S. Pat. No. 5,499,710 holds and retains two quarter dollars. One apparent drawback of such a device is that other coins cannot be held and retained, resulting in a build up of loose change once again.

BRIEF SUMMARY OF THE INVENTION

In view of the foregoing, one of the objectives of the present invention is to provide methods and devices for retaining coins which overcome the drawbacks of conventional techniques.

It is an additional object of the present invention to provide a change card for holding a particular combination of coins which enables a user to make exact change for any purchase.

It is yet another object of the present invention to provide a change card for holding a particular combination of coins which enables a user to make any purchase in such a way that each coin of any change received in return is receivable by the change card.

These and other objects are achieved by the change card of the present invention which enables a person to make exact change on any purchase and/or to receive all of the change resulting from a purchase, thereby eliminating the accumulation of pocket change.

In accordance with one aspect of the present invention, a change card includes a body and a plurality of bays disposed on the body. Each of the bays is adapted to releasably receive a coin. One of the many features of the invention is that the change card may be configured to be about the same size as a credit card so that the change card may be conveniently carried in a wallet or a purse. The advantages of this features are augmented by a particular configuration of the change card in which a predetermined number of bays are provided which receive a combination of coins which enables exact change of any fraction of a monetary unit to be made. For example, in the United States, the predetermined number of bays includes four bays each for receiving a penny, one bay for receiving a nickel, two bays each for receiving a dime, and three bays each for receiving a quarter, which totals 10 coins. Accordingly, exact change may be made for a purchase of given dollar amount and any fractional amount in cents, ranging from 1¢ to 99¢. Another advantage of the change card of the present invention is that any change resulting from a purchase made in accordance with the present invention is always receivable on the change card, which will be discussed in detail in the description below.

Other objects, features, and advantages of the present invention will become apparent to those skilled in the art from a consideration of the following detailed description taken in conjunction with the accompanying drawings which illustrate, by way of example, the principles of the present invention in the context of a change card configured to hold United States coins, but which are equally relevant to other monetary systems of the world.

BRIEF DESCRIPTION OF THE SEVERAL VIEWS OF THE DRAWINGS

FIG. 3C' is an enlarged cross-sectional view of that of FIG. 3C;

DETAILED DESCRIPTION OF THE INVENTION

Figure 1:
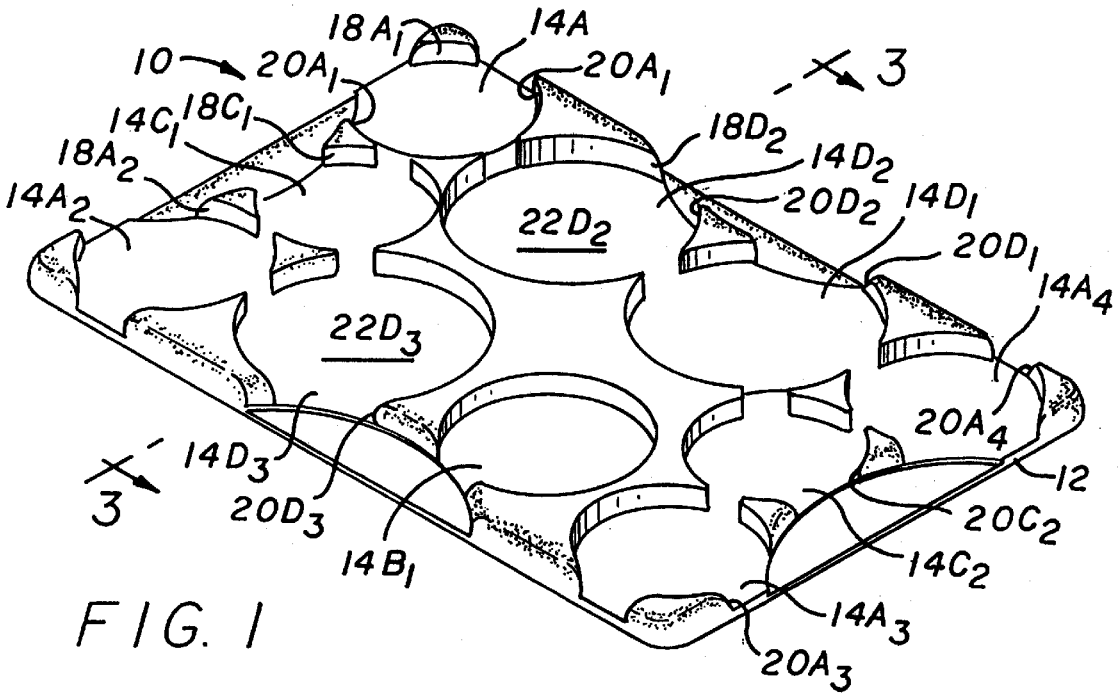
FIG. 1 is a perspective view of an exemplary change card in accordance with the present invention, particularly illustrating the card without coins.
Figure 2:
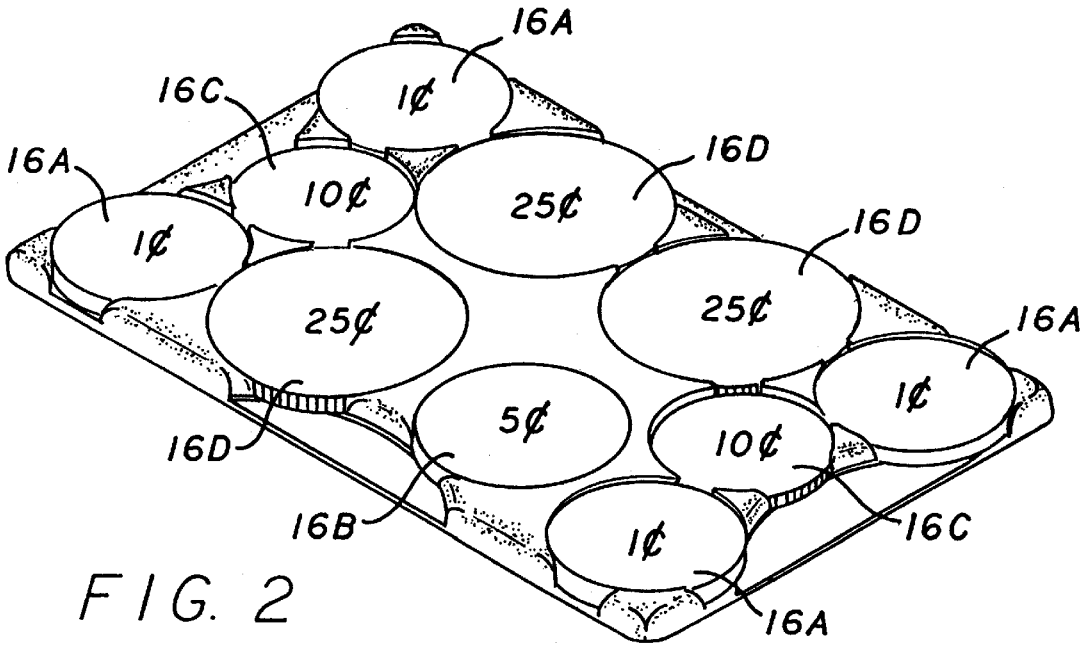
FIG. 2 is a perspective view of the change card, particularly illustrating the card holding a predetermined combination of coins.

Referring more particularly to the drawings, an exemplary change card 10 configured in accordance with the teachings of the present invention is illustrated in FIGS. 1 and 2. For purposes of explanation and without limiting the scope of the present invention, exemplary change card 10 is illustrated as a credit card-sized change card for holding coins of United States or Canadian denominations. However, the principles of the present invention are equally applicable to other monetary systems around the world, which will be discussed in more detail below.

Exemplary change card 10 includes a body 12 in which are formed a plurality of bays. The body 12 may be made from material which is either substantially rigid or substantially flexible depending upon the desired characteristics of the change card 10. The bays are generally referenced with numeral 14 in the drawings, and each of the bays 14 is specifically referenced with an alpha suffix, e.g., 14A, 14B, 14C, . . . 14N, in which N is a predetermined number of sets of bays 14, which will be discussed in detail below. In addition, each specifically referenced bay has a numeric subscript, e.g., $\mathbf{14}A_1$, $\mathbf{14}A_2$, $\mathbf{14}A_3$ . . . $\mathbf{14}A_n$, in which n is a predetermined number of bays 14 in a specific set of bays, for example, set A. This referencing convention will be utilized throughout this description for other elements of the change card 10.

The plurality of bays 14 are divided into a predetermined number of sets, with each set indicated in the drawings by an alpha suffix A, B, C, . . . N. In the exemplary embodiment of the change card 10 of the present invention illustrated in the drawings, set A of the plurality of bays 14 includes bays indicated by reference 14A; set B of the plurality of bays 14 includes bays indicated by reference 14B; set C of the plurality of bays 14 includes bays indicated by reference 14C; and set D of the plurality of bays 14 includes bays indicated by reference 14D. As mentioned, the plurality of bays 14 includes a predetermined number of sets (i.e., N) of bays.

Each of the bays 14 is configured or adapted to receive a coin 16. More specifically, each bay of a specific set A, B, C, . . . N receives a coin of specific denomination. The coins 16 illustrated in the drawings are indicated by the same referencing convention as that of the bays 14. In the exemplary embodiment of change card 10 shown in FIGS. 1 and 2, the coins 16 include the following coins minted by the United States or Canadian treasury: a penny 16A, which is equal to 1/100 of a dollar or 1¢; a nickel 16B, which is equal to 1/20 of a dollar or 5¢; a dime 16C, which is equal to 1/10 of a dollar or 10¢; and a quarter 16D, which is equal to 1/4 of a dollar or 25¢.

As illustrated, each of the bays 14A of set A (i.e., bay $\mathbf{14}A_1$, $\mathbf{14}A_2$, $\mathbf{14}A_3$, and $\mathbf{14}A_4$) is adapted to receive a penny 16A; each of the bays 14B of set B (i.e., bay $\mathbf{14}B_1$) is adapted to receive a nickel 16B; each of the bays 14C of set C (i.e., bay $\mathbf{14}C_1$ and $\mathbf{14}C_2$) is adapted to receive a dime 16C; and each of the bays 14D of set D (i.e., bay $\mathbf{14}D_1$, $\mathbf{14}D_2$, and $\mathbf{14}D_3$) is adapted to receive a quarter 16D. Although change card 10 exemplifying the principles of the present invention is configured to receive coins of value less than a quarter dollar, exemplary change card 10 may be configured to receive coins of greater value, for example, half-dollar coins and dollar coins.

Although each set A, B, C, . . . N may include any predetermined number of bays 14, change card 10 is particularly configured to hold a combination of coins 16 with which any fraction of a dollar may be made. For example, the plurality of bays 14 are configured to hold four pennies 16A, one nickel 16B, two dimes 16C, and three quarters 16D. With this combination of coins 16, correct change from 1¢ to 99¢ may be made, as well as $1.00, $1.01, $1.02, $1.03, and $1.04. Accordingly, a user may utilize change card 10 to make exact change when making purchases. For example, if an item costs 65¢, then the user may remove two quarters 16D, one dime 16C, and one nickel 16B. If an item costs $1.33, then a user may remove one quarter 16D, one nickel 16B, and three pennies 16A, in addition to providing a dollar bill in cash.

In addition to providing exact change, the particular configuration of bays 14 of change card 10 allows change resulting from a purchase to be accommodated by the card. For example, assuming each of the bays 14 is receiving a particular coin 16 as described above prior to making a purchase, if an item costing 65¢ is purchased, then two quarters 16D, one dime 16C, and one nickel 16B are removed from the change card. Accordingly, after the purchase, two quarter bays 14D are vacant, one dime bay 14C is vacant, and one nickel bay 14B is vacant. If an item costing $1.70 is subsequently purchased and the user gives two dollars in cash (i.e., two one-dollar bills), thereby receiving 30¢ in change consisting of one quarter and one nickel, then the quarter may be inserted into one of the vacant quarter bays 14D and the nickel may be inserted into the vacant nickel bay 14B. Accordingly, there is no excess change resulting from the purchase which is not able to be received in one of the vacant bays.

Taking this example a step further, with one of the quarter bays 14D and one of the dime bays 14C vacant, assume an item costing 97¢ is purchased. As change card 10 is holding only 69¢, the user will need to use a dollar bill to make the purchase. If the purchase is made with only a dollar bill, then the user will receive 3¢ in change consisting of three pennies. However, each of the penny bays 14A is occupied by a penny 16A, so that the user will have excess change (i.e., change not receivable in the change card) if the purchase is made with a single one dollar bill. However, if the user, anticipating the change resulting from the purchase, makes the 97¢ purchase with a one-dollar bill, along with the nickel 16B and two of the pennies 16A held by change card 10, which totals $1.07, then the user will receive a dime as change, which can be inserted into the vacant dime bay 14B so that there is no excess change (i.e., change that cannot be retained by the change card) after the purchase. After making such a purchase, there will be a vacant quarter bay 14D, a vacant nickel bay 14B, and two vacant penny bays 14A.

In accordance with the foregoing, the plurality of bays of the exemplary change card 10 of the invention are configured to hold and retain a combination of coins that enables a person (1) to make exact change on any purchase when all of the bays 14 are occupied with coins and (2) to receive all of the change resulting from a purchase when at least one of the bays 14 is vacant. Accordingly, rather than accumulating a pocket or coin purse full of change, the maximum number of coins a user needs to manage at one time is 10 (i.e., three quarters, two dimes, one nickel, and four pennies).

Figure 3A:
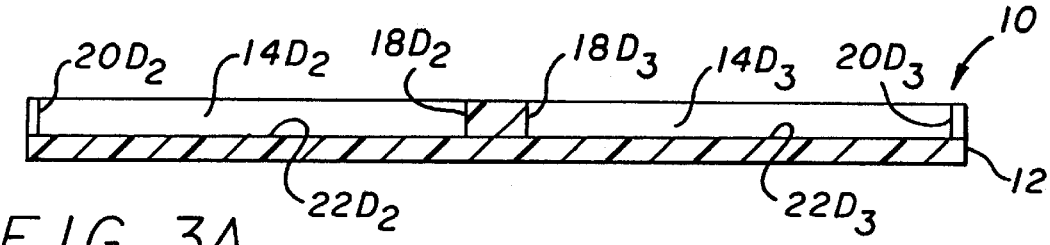
FIG. 3A is a cross-sectional view of the change card taken along line 3—3 of FIG. 1.

Referencing FIGS. 1 and 3A, each of the bays 14 is formed in the body 12 as a recess defined by a wall 18. Although each or any number of the walls 18 may be completely annular (that is, extend 360° around the bay), in accordance with the exemplary embodiment of the change card 10 shown in the drawings, each of the walls 18 is partially annular, thereby defining a notch 20 along a portion of the wall. The notches 20 facilitate the removal of the coins 16 from the bays 14. As can be seen in FIG. 1, more than one notch 20 may be defined in the wall of a bay 14. For example, wall 18$A_1$ of bay 14$A_1$ has two notches 20$A_1$ formed therein.

Figure 3B:
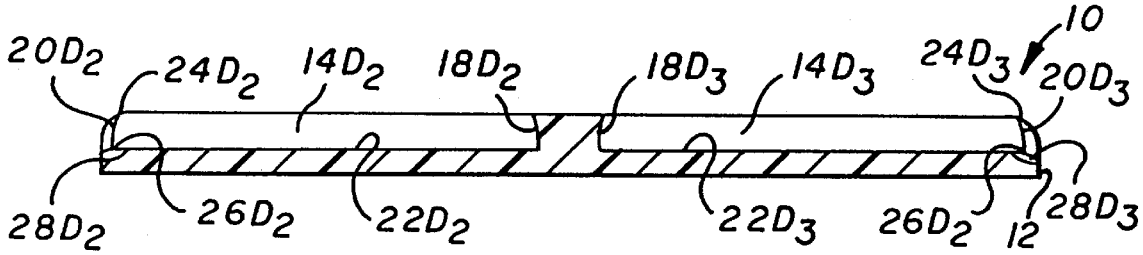
FIG. 3B is a cross-sectional view of the change card taken along line 3—3 of FIG. 1, illustrating an alternative embodiment of the change card.

In addition to the wall 18, each of the bays 14 has a face 22. As shown in FIG. 3A, the wall 18 and the face 22 of the bay 14 may be substantially linear in configuration and may be substantially perpendicular with each other. Alternatively, as shown in FIG. 3B, the wall 18 of each bay 14 may be substantially curvilinear, for example, concave, in configuration, tapering outward from a top edge 24 thereof to a bottom edge thereof 26. With a concave-like configuration, when urged into a bay 14, a coin 16 snaps past the top edge 24 of the wall to be received within the bay 14. In other words, exemplary bays 14 of FIG. 3B may be configured to have a diameter at the top edge 24 less than a diameter of the bottom edge 26. Accordingly, with the body 12 made from a resilient material such as plastic, a snapping action of the coins 16 into and out of the bays 14 is effected. Also illustrated in FIG. 3B, each of the bays 14 may have a depression 28 formed at or near the notch 20 and configured for receiving a fingernail of a user to facilitate in the upward removal of a coin 16 from a bay 14.

Figure 3C:
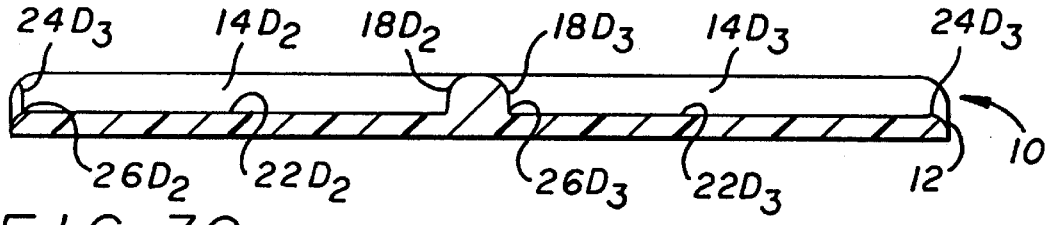
FIG. 3C is a cross-sectional view of the change card taken along line 3—3 of FIG. 1, illustrating another embodiment of the change card.

Rather than configuring the walls 18 of the bays 14 in a concave manner, the walls 18 may be substantially convex in configuration as shown in FIG. 3C. In the convex embodiment, the diameter of the top edge 24 of each bay 14 is larger than the diameter of the bottom edge 26. The bays 14 may be configured such that a lower portion of the wall 18 is substantially perpendicular with the face 22 before curving outward toward the top edge 24. FIG. 3C' shows a preferred convex embodiment of the bays 14. As shown, a lower portion 18' of the wall is substantially perpendicular with the face 22, with an upper portion 18" of the wall curving outwardly. The perpendicular lower portion 18' of the wall retains the coin 16 in the bay 14, and the convex upper portion 18" of the wall facilitates the insertion and removal of the coin 16 from the bay 14.

Figure 3D:
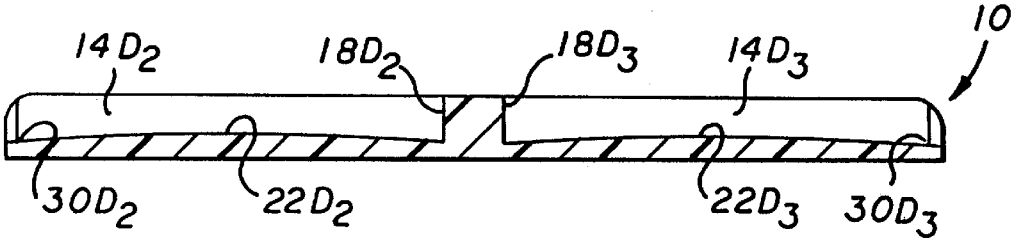
FIG. 3D is a cross-sectional view of the change card taken along line 3—3 of FIG. 1, illustrating yet another embodiment of the change card.
Figure 3C:
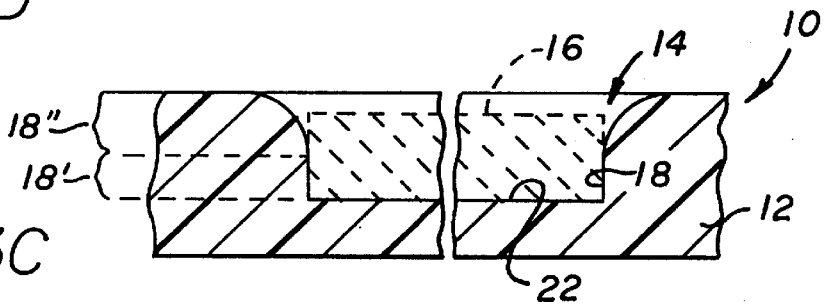

Another alternative embodiment of exemplary change card 10 is illustrated in FIG. 3D, in which the face 22 of each bay 14 has an annular depression 30 defined at the intersection with the wall 18. The face 22 with the annular depression 30, which may be substantially convex in cross section, acts as a broad fulcrum against which a coin 16 may be pivoted to facilitate the removal from a bay 14. More specifically, to remove a coin 16 from a bay 14, a user may urge a peripheral portion of the coin 16 downward into the annular depression 30 so that a diametrically opposite peripheral portion of the coin 16 rises beyond the vertical extent of the wall 18 and out of the bay 14.

As discussed above, the plurality of bays of the exemplary change card 10 of the present invention are configured to hold and retain a combination of coins that enables a person to make exact change on any purchase when all of the bays 14 are occupied with coins and to receive all of the change resulting from a purchase when at least one of the bays 14 is vacant, so that a user never needs to manage more than 10 coins at one time. Augmenting this convenient feature of the invention is that exemplary change card 10 may be configured to have dimensions substantially the same as an ordinary credit card.

Figure 4:
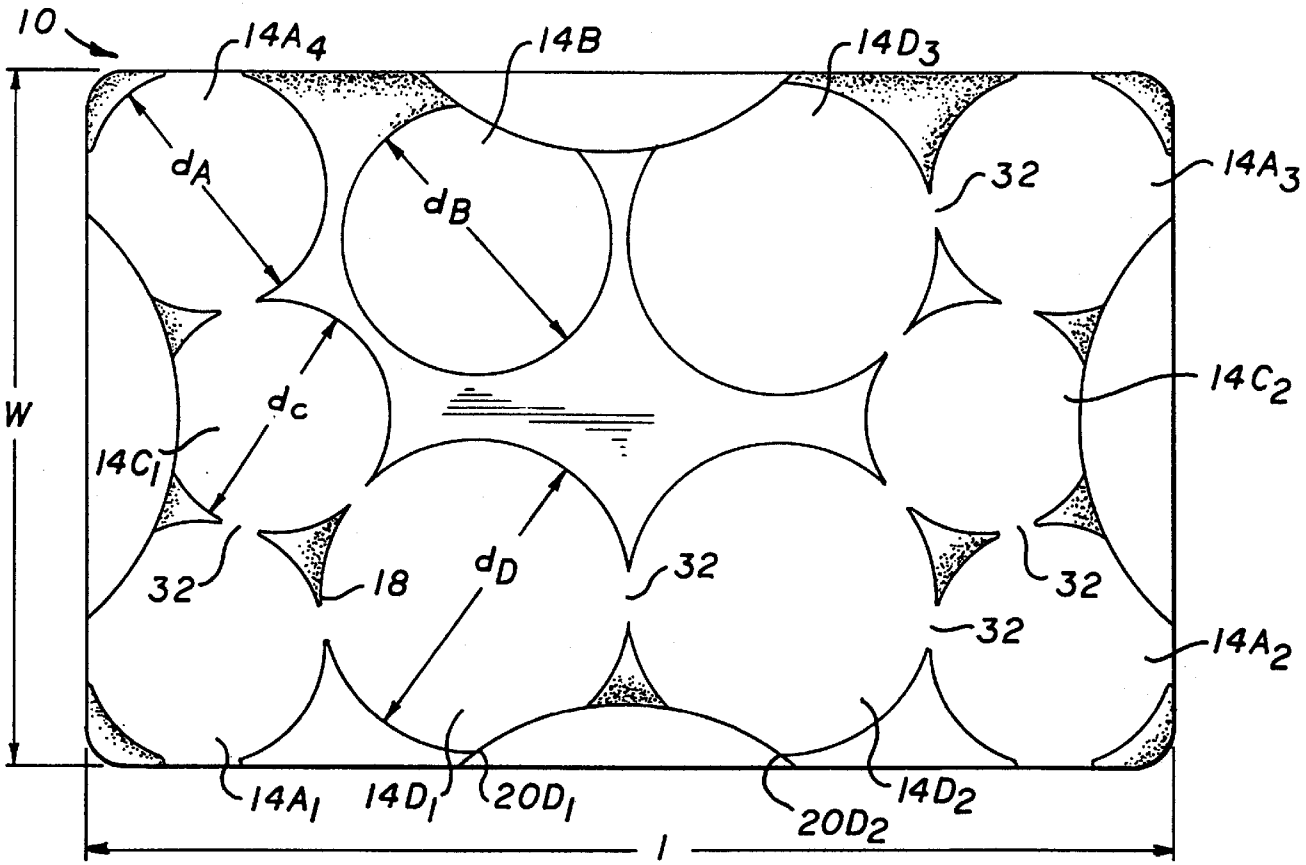
FIG. 4 is a top plan view of an exemplary change card of the present invention, particularly illustrating a specific credit card-sized embodiment of the change card.

In this regard, reference is made to FIG. 4, which illustrates a specific commercial embodiment of the change card 10 of the invention. Credit card-configured change card 10 not only retains a combination of coins which is able to make exact change for any purchase (i.e., three quarters, two dimes, one nickel, and four pennies), but also fits conveniently in wallets, purses, and other holders designed to hold credit cards. Matching the dimensions of a credit card in a substantially equal manner, change card 10 illustrated in FIG. 4 has a width w on the order of about 50 millimeters (mm) to 60 mm and a length l on the order of about 80 mm to 90 mm, or, more specifically, a width w of 54.0 mm and a length l of 85.6 mm.

Figure 5:
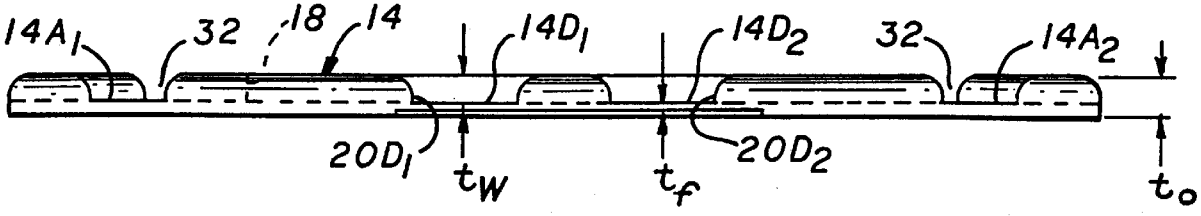
FIG. 5 is a side plan view of the change card of FIG. 4.

With additional reference to FIG. 5, although change card 10 may have any desired thickness, it is preferable to minimize the thickness of the credit card-configured change card (so as to minimize the bulkiness of the change card in, for example, a wallet) while maintaining the capability of the change card to hold and retain coins. In a preferred embodiment, change card 10 has an overall thickness $t_O$ of about 2.9 mm. The walls 18 of the bays 14 have a thickness $t_W$ which may range from about 2.52 mm for a nickel bay 14B to about 2.15 mm for a dime bay 14C. Generally speaking, the overall thickness of the card may be defined as substantially equal to the minimum desired thickness of the face $t_F$ plus the thickness of the thickest coin 16 to be received by the card. In an embodiment of the change card 10 for retaining coins of the United States, a diameter $d_A$ of penny bays 14A is on the order of 19.05 mm; a diameter $d_B$ of nickel bay 14B is on the order of 21.21 mm; a diameter $d_C$ of dime bays 14C is on the order of 17.91 mm; and a diameter $d_D$ of quarter bays 14D is on the order of about 24.26 mm.

In order to provide four penny bays 14A, one nickel bay 14B, two dime bays 14C, and three quarter bays 14D on a change card 10 having a length and a width substantially equal to that of a credit card, the plurality of bays 14 are preferably configured according to that shown in FIG. 4, with the penny bays 14A situated at or near the comers of the card, each of the dime bays 14C situated transversely adjacent to a respective pair of penny bays, two of the quarter bays 14D (i.e., bays 14$D_1$ and 14$D_2$) situated laterally between two of the penny bays (i.e., bays 14$A_1$ and 14$A_2$), and the nickel bay 14B and the third quarter bay (i.e., bay 14$D_3$) situated laterally between the other two penny bays (i.e., bays 14$A_3$ and 14$A_4$).

In addition, respective bays 14 may be substantially tangent to each adjacent bays, that is, are coextensive along a portion of the respective walls 18 thereof, which coextensive portions are indicated with numeral 32. For example, penny bay 14$A_1$ shares a coextensive portion 32 with dime bay 14$C_1$ and a coextensive portion 32 with quarter bay 14$D_1$. By minimizing the space between adjacent bays to the point where coextensive portions 32 are defined, the plurality of bays 14 including four penny bays 14A, one nickel bay 14B, two dime bays 14C, and three quarter bays 14D are able to be disposed on a credit card-sized change card 10. Generally speaking, when taking into consideration any notches 20 and coextensive portions 32 of a particular bay 14, the extent or the configuration of the wall 18 around each of the bays 14 is sufficient to retain a coin 16 in a secure manner.

In addition to the exemplary credit card-sized embodiment described above, the principles of the present invention allow the change card 10 to be configured in any desired manner. For example, rather than having all of the bays 14 disposed on a single side of the body 12, a number of bays 14 may be disposed on one side of the body and a number of bays 14 may be disposed on the other side of the body. In addition, rather than configuring the change card 10 in a rectilinear manner shown in the drawings, the change card may be, for example, oval, elliptical, circular, or polygonal in shape.

As obvious to those skilled in the art after reading this description to gain an understanding of the principles of the invention, change cards may be configured to hold, retain, and dispense coins of any denomination from any monetary system in the world. Generally speaking, each monetary system include a basic monetary unit which is subdivided into other units. For example, the dollar is the basic monetary unit of many English-speaking countries (including the United States and many of the former British Commonwealth states, such as Canada, Australia, New Zealand, Hong Kong, and Singapore, to name a few). The dollar is subdivided into 100¢. Other common monetary units include the peso and the franc, with the peso being the monetary unit of many Spanish-speaking countries and subdivided into 100 centavos and the franc being the monetary unit of many French-speaking countries and subdivided into 100 centimes.

The subdivision of a monetary unit allows any fraction of the monetary unit to be represented. For example, 37/100 of a dollar is equal to 37¢; 1/50 of a franc is equal to 2 centimes; and ½ of a peso is equal to 50 centavos. Most monetary systems include coins of denominations equal to fractions of the basic monetary unit. For example, as mentioned above, the United States mints coins in the following fractions of a dollar: 1/100, 1/20, 1/10, ¼, and ½, as well as a 1/1 of one dollar. Other monetary systems issue coins for similar denomination. In addition to those factions of the United States dollar, many systems issue coins in the following fractions of their respective monetary units: 1/50, 1/20, and 1/5. Some monetary systems issue coins of twice the value of their monetary unit; for example, Australia issues a $2 coin, and Italy issues a 1,000 lira coin. Accordingly, the term fraction used herein includes fractions less than one, equal to one, and greater than one. Depending upon the monetary system, change card 10, particularly the plurality of bays 14, may be configured to hold and retain a predetermined number of coins of each denomination of the particular monetary system, in order to enable an exact change to be produced and change resulting from a purchase to be retained.

In addition to the specific credit card-sized embodiment shown in FIGS. 4 and 5, exemplary change card 10 of the invention may be configured in other useful dimensions for specific purposes. For example, change card 10 may include an attachment for mounting the change card to a key chain or other device commonly carried on one's person for the convenient distribution and retention of coins. Alternatively, the change card 10 may be incorporated as a feature in purses and wallets to hold loose change.

The methodology for using the change card 10 in accordance with the present invention is not only applicable to the utilitarian uses described above but may also be applied in educational uses to teaching analytical skills. The principles of the present invention may thus be incorporated into a games or puzzles designed to enhance such skills. More specifically, the plurality of bays 14 of the exemplary change card 10 are configured to hold a predetermined combination of coins that enables a person (1) to make exact change on any purchase when all of the bays 14 are occupied with coins and (2) to receive all of the change resulting from a purchase when at least one of the bays 14 is vacant. Returning to the example provided above in which one of the quarter bays 14D and one of the dime bays 14C were vacant, the user needed to use a dollar bill to purchase an item costing 97¢, because the change card 10 was holding only 69¢. As mentioned, if the purchase were made with only a dollar bill, then the user would receive 3¢, in change consisting of three pennies 16A, which could not be received by the change card 10 because each of the penny bays 14A was occupied by a penny. Accordingly, the user needed to anticipate the change resulting from the 97¢ purchase and present change held by the change card 10—in addition with a one-dollar bill—that is, the nickel 16B and two of the pennies 16A, to total $1.07 in order to receive a dime as change which is insertable into the vacant dime bay 14B.

After making such a purchase, there will be a vacant quarter bay 14D, a vacant nickel bay 14B, and two vacant penny bays 14A, for a total of 72¢ on the card 10. Depending upon the amount of the next subsequent purchase, the user may either (1) make exact change for the purchase, e.g., 25¢, $1.11, $4.02, etc., (2) provide a combination of change from the card and cash so yield a combination of change from the purchase which is receivable in the vacant bays 14 of the card, e.g., provide $5.21 for a purchase totaling $4.91 to receive 30¢ in change consisting of a quarter and a nickel, or (3) receive all of the change resulting from a purchase on the card, e.g., 95¢, $1.75, $9.98, etc.

Figure 6:
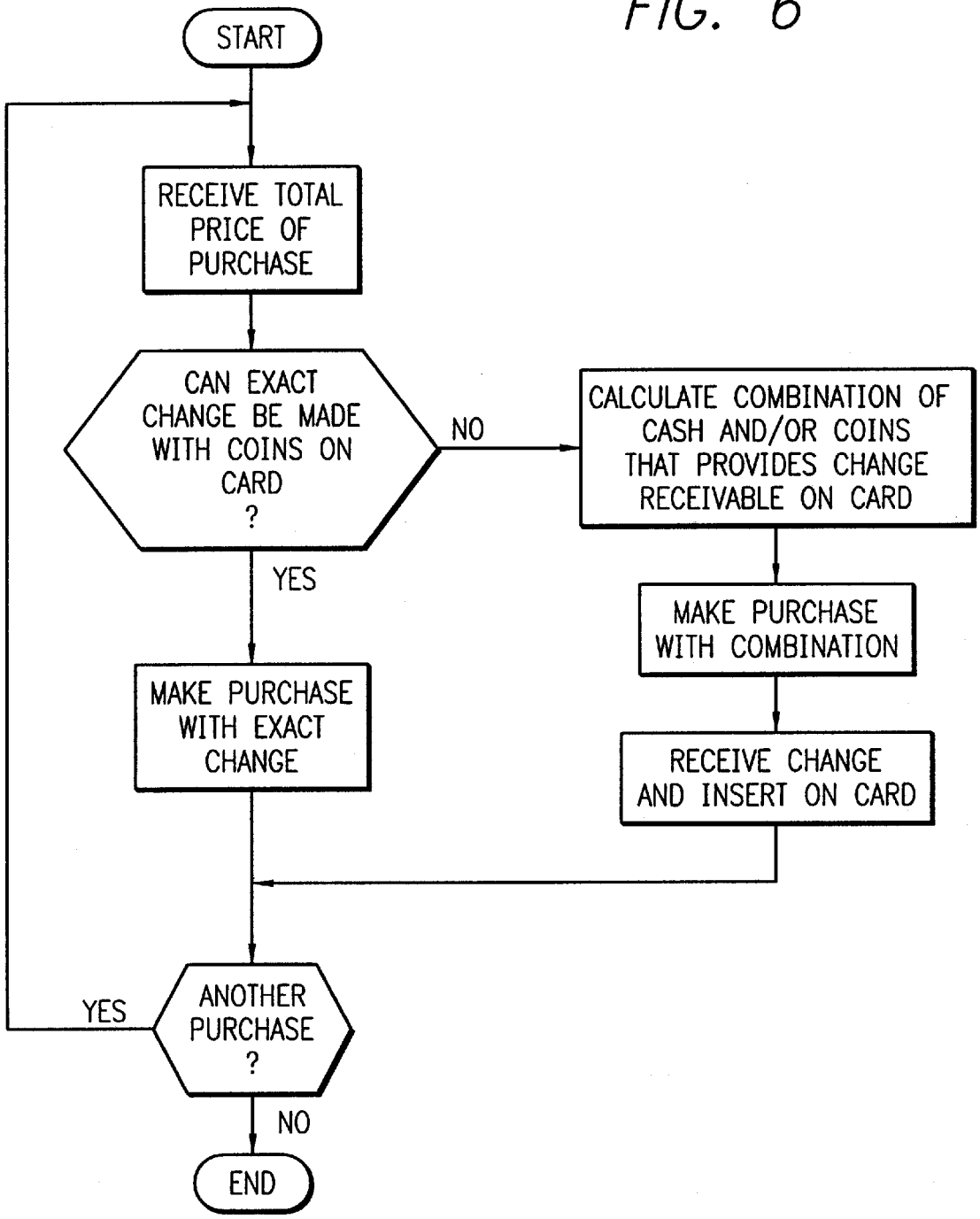
FIG. 6 is a block diagram of a flowchart illustrating methodology for using the change cards of the present invention.

The methodology of the invention is outlined in FIG. 6 and may be summarized as a process for teaching one to determine when exact change may be made from the coins currently received on the change card, and, if so, to make such exact change for the purchase. If exact change cannot be made with the coins currently on the card, one may then calculate the change received from making such a purchase with cash and/or coins available on the card, which change will be receivable in the vacant bays currently on the card. The user then proceeds with the purchase, receives the calculated change, and inserts the change on the card. This process may be repeated a plurality of times as desired.

Figure 7:
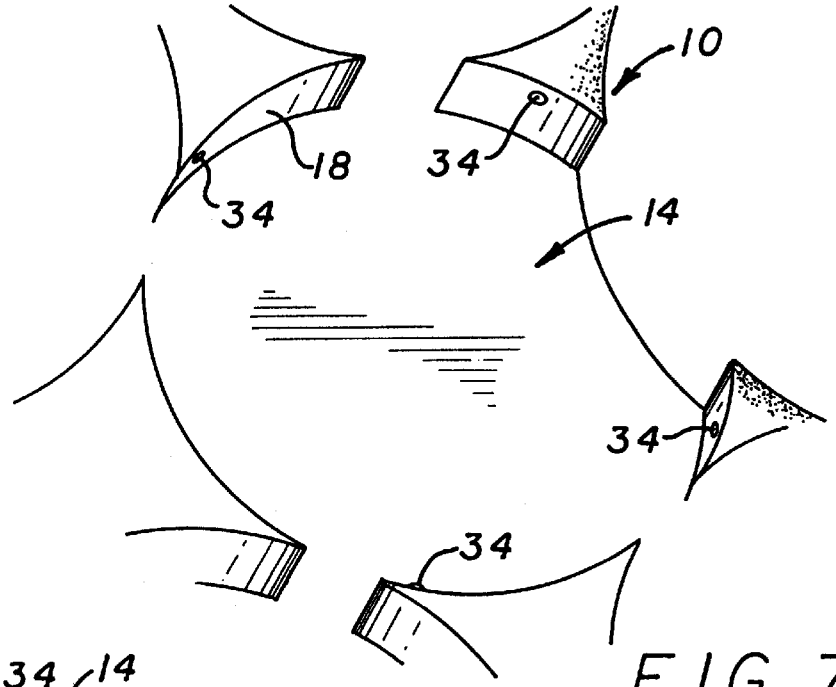
FIG. 7 is a fragmentary perspective view of a bay of an exemplary change card of the present invention, particularly illustrating a preferred embodiment of retaining structure disposed in the bay.
Figure 8:
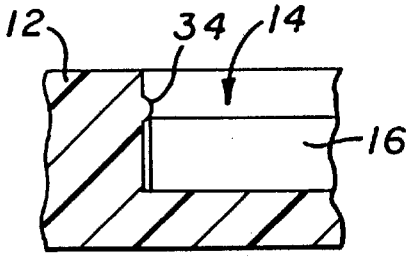
FIG. 8 is a fragmentary cross-sectional view of the retaining structure of FIG. 7, illustrating a coin held within the bay.

In addition to the alternative configurations of the bays 14 for retaining a coin 16 therein, exemplary change card 10 of the present invention may include retaining structure for securely and releasably retaining coins in the bays. In this regard, reference is made to FIGS. 7, 8, and 9 which respectively illustrate alternative embodiments of such retaining structure. In FIG. 7, exemplary change card 10 may include a plurality of nubs 34 disposed on an upper portion of the wall 18 in a spaced relationship about each bay 14. The nubs 34 are preferably positioned at an upper vertical location on the wall 18 so that a coin is urged past the nubs 34 to be received within the bay 14, as shown in FIG. 8. Once received in the bay 14, the nubs 34 project over a top surface of the coin 16 to retain the coin in the bay. Although any number may be used, in a preferred embodiment of the card 10 there are three nubs 34 positioned about the bay 14 so as to securely retain a coin 16 therewith. The nubs 34 may be made from the same resilient material as that of the body 12 and formed as hemispherical protrusions on the wall 18.

Figure 9:
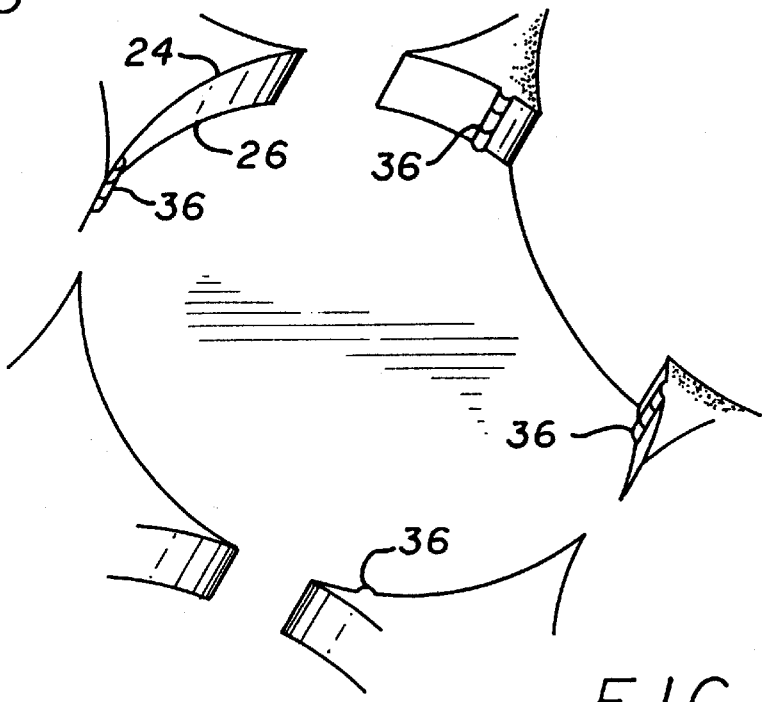
FIG. 9 is a fragmentary perspective view of a bay of an exemplary change card of the invention, particularly illustrating an alternative embodiment of retaining structure.

In FIG. 9, rather than nubs, each of the bays 14 may include a plurality of columnar projections 36 disposed in a spaced relationship about the bay. Projections 36, which are preferably shaped as half rounds, may extend from the top edge 24 to the bottom edge 26 of the wall 18. The frictional forces between the projections 36 and the coin 16 created by urging the coin down into the bay 14 retains the coin within the bay. Projections 36 may be made from the same resilient material as that of the body 12 and are preferably integral therewith. Although any distance may be used, the nubs 34 and the columnar projections 36 may project on the order of about 0.1 mm away from the wall 18.

Those skilled in the art will understand that the preceding exemplary embodiments of the present invention provide the foundation for numerous alternatives and modifications thereto. These other modifications are also within the scope of the present invention. Accordingly, the present invention is not limited to that precisely as shown in the accompanying drawings and described above.

What is claimed is:

1. A change card for retaining coins, said change card comprising:

a body having a width of less than approximately 60 mm, a length of less than approximately 90 mm, and a thickness of less than approximately 3 mm; and a plurality of bays disposed on said body, said plurality of bays including:

four bays each adapted for releasably engaging a penny;

one bay for releasably engaging a nickel;

two bays each for releasably engaging a dime; and three bays each for releasably engaging a quarter;

at least two of said bays being coextensive along a portion thereof.

2. A change card as claimed in claim 1 wherein said body has a length of approximately 85.6 mm and a width of approximately 54.0 mm.

3. A change card as claimed in claim 1 further comprising retaining structure disposed on each of said bays for retaining the coin therein.

4. A change card as claimed in claim 3 wherein said retaining structure includes a plurality of hemispherical projections disposed in a spaced relationship about said bay.

5. A method for holding and distributing coins, said method comprising the steps of:

providing a change card including:

a body having a width of less than approximately 60 mm, a length of less than approximately 90 mm, and a thickness of less than approximately 3 mm; and a plurality of bays disposed on said body, said plurality of bays including:

four bays each adapted for releasably engaging a penny;

one bay for releasably engaging a nickel;

two bays each for releasably engaging a dime; and three bays each for releasably engaging a quarter;

at least two of said bays being coextensive along a portion thereof; and inserting a specific coin into each of said bays.

6. A method as claimed in claim 5 further comprising the step of:

removing coins from said bays to make exact change for a purchase, thereby leaving a number of vacant bays and a number of occupied bays in which a coin is still received.

7. A method as claimed in claim 6 further comprising the step of:

determining whether exact change for a subsequent purchase can be made with said coins received in said occupied bays.

8. A method as claimed in claim 7 further comprising the step of:

determining whether change, resulting from said subsequent purchase if said subsequent purchase is made with cash, is receivable in said vacant bays.

9. A method as claimed in claim 8 further comprising the step of:

calculating a combination of cash and said coins received in said occupied bays which results in an amount of change which is receivable in said vacant bays.

10. A method as claimed in claim 9 further comprising the step of:

repeating said determining steps and said calculating step a plurality of times for further subsequent purchases.

* * * * *